US007175464B2

(12) United States Patent
Ferderer et al.

(10) Patent No.: US 7,175,464 B2
(45) Date of Patent: Feb. 13, 2007

(54) LATCHING DEVICE FOR A CONNECTOR

(75) Inventors: Albert Ferderer, Espelkamp (DE); Martin Schmidt, Lübbecke (DE)

(73) Assignee: Harting Electric GmbH & Co. KG (DE)

( * ) Notice: Subject to any disclaimer, the term of this patent is extended or adjusted under 35 U.S.C. 154(b) by 0 days.

(21) Appl. No.: 11/383,359

(22) Filed: May 15, 2006

(65) Prior Publication Data

US 2006/0276070 A1 Dec. 7, 2006

(30) Foreign Application Priority Data

Jun. 4, 2005 (DE) ..... 10 2005 025 769

(51) Int. Cl.
*H01R 13/627* (2006.01)

(52) U.S. Cl. ..... 439/352

(58) Field of Classification Search ..... 439/352, 439/353, 357, 358

See application file for complete search history.

(56) References Cited

U.S. PATENT DOCUMENTS 5,318,457 A 6/1994 Harting et al. ..... 439/352
6,056,577 A * 5/2000 Blanchet ..... 439/352
6,093,043 A * 7/2000 Gray et al. ..... 439/352
6,464,526 B1 * 10/2002 Seufert et al. ..... 439/352
2003/0157825 A1 * 8/2003 Kane ..... 439/352
2004/0132329 A1 * 7/2004 Shimoyama et al. ..... 439/352

FOREIGN PATENT DOCUMENTS

DE 42 05 960 2/1992

* cited by examiner

*Primary Examiner*—Tho D. Ta
(74) *Attorney, Agent, or Firm*—Hayes Soloway P.C.

(57) ABSTRACT

In order to latch a separable plug-type connection that is composed of an upper housing part and a lower housing part with an axially displaceable unlatching ring that encompasses the upper housing part, the invention proposes to provide the unlatching ring with actuating tabs that act upon latching elements arranged between the upper housing part, the lower housing part and the unlatching ring. When pressure is exerted upon the actuating tabs, the latching mechanism is released first and the interlocking mechanism is released when the connection is separated.

11 Claims, 5 Drawing Sheets

LATCHING DEVICE FOR A CONNECTOR

FIELD OF THE INVENTION

The invention pertains to a latching device for connector housing halves in the form of an upper housing part and a lower housing part with an axially displaceable unlatching ring that encompasses the upper housing part.

BACKGROUND OF THE INVENTION

A latching device of this type is required for positively interlocking two connector housings in the joined state and for preventing an unintentional separation of the connection due to vibrations or tensile forces.

DESCRIPTION OF THE RELATED ART

DE 42 05 960 C2 discloses a connector with interlockable housing halves, in which the latching elements are provided with springable snap-in pawls that are arranged in a sleeve surrounding the two housing halves in the connected state, wherein the snap-in pawls arranged in one housing half engage into recesses in the other housing half. The snap-in pawls can be levered out of the recesses by pulling on the sleeve such that the connector is unlatched.

SUMMARY OF THE INVENTION

The invention is based on the objective of additionally developing a latching device for connectors of the initially cited type in such a way that an additional latch is provided in addition to the interlocking of the two connectors.

This objective is attained in that the unlatching ring features at least one actuating tab that is detached on three sides and can be moved inward, wherein a release pawl with an inwardly directed angled section is integrally formed onto said actuating tab, in that an outwardly directed locking pawl with an angled section is integrally formed onto the upper housing part, and in that the angled section is arranged such that it contacts, in the latched state of the connector, the angled section of the locking pawl that is directed outward from the upper housing part.

The advantages attained with the invention can be seen, in particular, in that the proposed connector realizes a combination of an interlock and an additional latch between a connector and a mating connector.

In this case, an interlocking mechanism that can be subjected to high loads and is realized in the form of a so-called push-pull interlock is combined with a latch in connector housings that consist of metallic or non-metallic material, wherein said latch is arranged in an unlatching ring that encompasses both housings.

Interlocking and latching means are provided in the unlatching ring, wherein it is advantageous that the interlocking and latching means initially produce an interlock and subsequently an additional latch between both connector housings.

Actuating tabs provided on the unlatching ring make it possible to release the latching means and, if pulling on the plug in a nearly simultaneous fashion, also the interlocking means of the connector.

The latching means consist of the same material as the connector and the unlatching ring, and the interlocking mechanism preferably consists of a metallic material, i.e., it is made of springable sheet metal, while the snap-in tabs are made of the material of the mating connector.

In this case, the punched-out interlocking mechanism of sheet metal contains at least one window-like cutout, preferably two separate cut-outs, into which engage corresponding snap-in tabs that are integrally formed onto the mating connector.

A metallic interlocking mechanism of sheet metal is advantageous in that the sheet metal of the interlocking mechanism can be utilized as a so-called PE-contact for transmitting the ground reference signal regardless of the connector housing material.

BRIEF DESCRIPTION OF THE DRAWINGS

One embodiment of the invention is described in greater detail below with reference to the figures. The figures show.

DESCRIPTION OF THE PREFERRED EMBODIMENT

Figure 1:
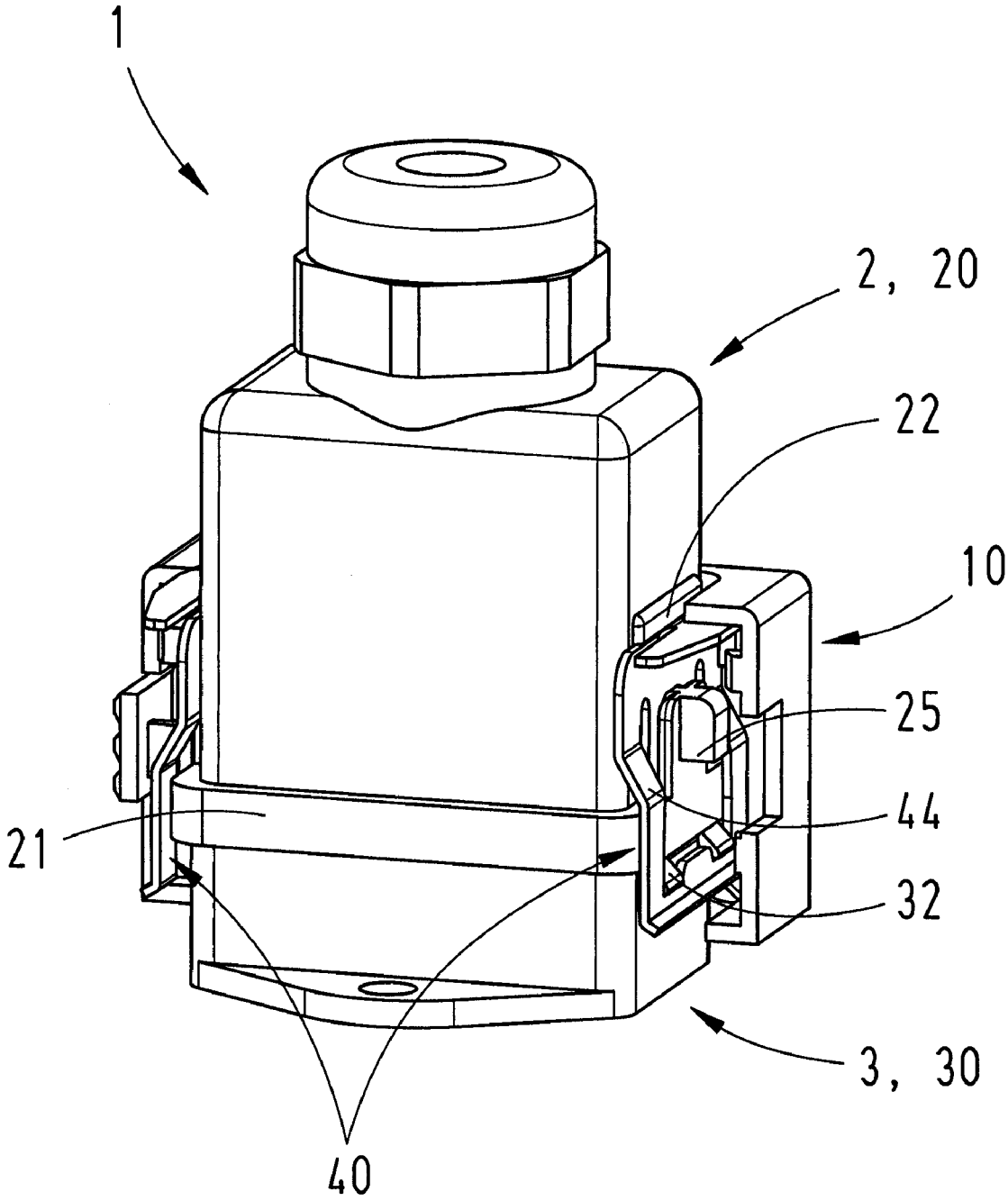
FIG. 1 is a perspective representation of a combined connector.

FIG. 1 shows a perspective representation of a combined connector 1 that consists of a connector 2 and a mating connector 3 with a mounting flange integrally formed thereon.

The connector and the mating connector are referred to as the upper housing part 20 and the lower housing part 30 in the following description.

Both housing parts are encompassed by an unlatching ring 10, wherein the front half of the unlatching ring is not shown such that at least part of the interlocking and latching mechanism is visible in the figure.

Within the unlatching ring 10, one respective interlocking plate 40 is fixed on the upper housing part 20 as shown on both narrow sides of the housing parts.

An angled bend 44 of the interlocking plate 40 extends over a peripheral collar 21 on the lower edge of the upper housing part, namely as far as two snap-in tabs 32 that protrude from the lower housing part 30 and engage with the interlocking plate.

A narrow strip 22 is arranged above the interlocking plate 40, wherein an integral part of the upper housing part that is referred to as the locking pawl 25 below protrudes from the center of the interlocking plate a short distance underneath the narrow strip.

Figure 5:
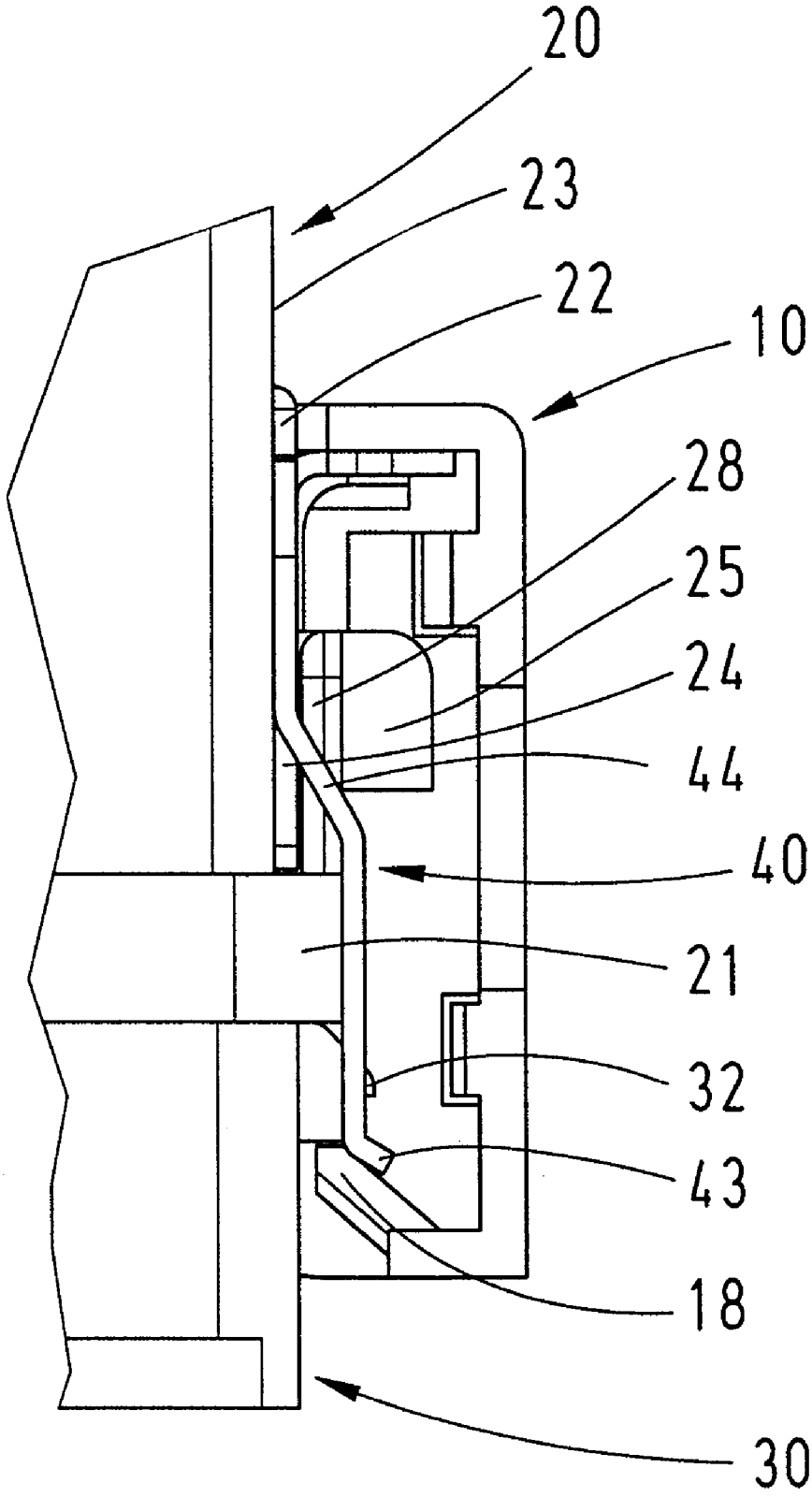
FIG. 5 is a side view of the interlocking mechanism.

One aspect that is not clearly visible in the figure is that the locking pawl 25 is integrally formed onto the narrow side 23 such that it is partially spaced apart from the wall and a slot 24 is formed, into which the interlocking plate 40 can be inserted until it is interlocked underneath the strip 22 (in this respect, see also FIG. 5).

Figure 2A:
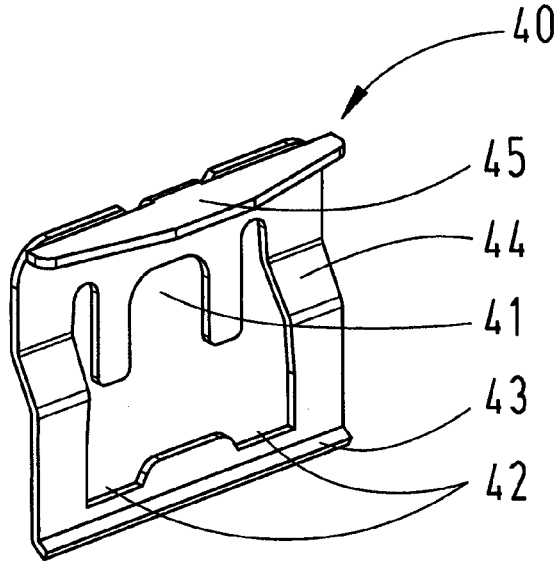
FIGS. 2*a*, 2*b* and 2*c* are several variations of a sheet metal interlocking mechanism.
Figure 2B:
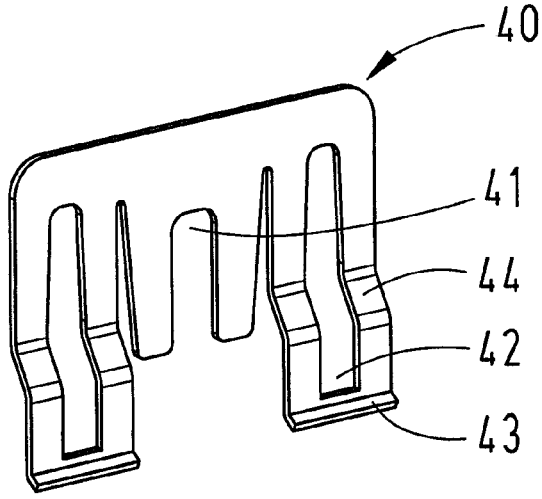
Figure 2C:
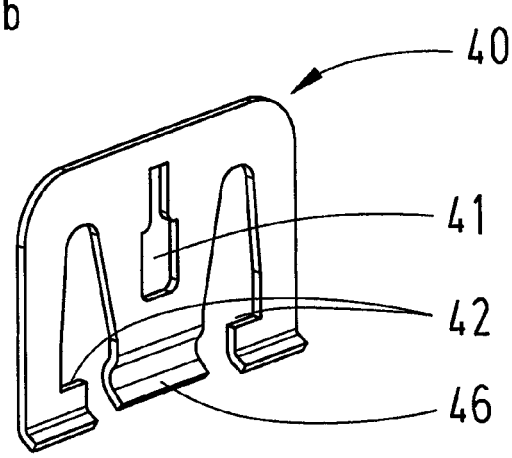

A few variations of the interlocking plate 40 to be interlocked on both narrow sides 23 of the upper housing part 2 are illustrated in detail in FIGS. 2*a–c*.

The interlocking plate is realized in the form of a punched metallic blank and provided with a window-like cutout 42, wherein the cutout may be realized in the form of a common window or divided into two separate windows (see FIGS. 2*a*, 2*b*).

The lower edge is angled in the form of a bevel 43 such that a ramp is formed that subjects the plate to an excursion when it contacts the snap-in tabs 32 on the lower housing part 3.

In addition, the two vertical braces 44 are bent at an angle approximately in their center such that the lower edge can extend over the collar 21 on the upper housing part 20 and be interlocked with the snap-in tabs 32 of the lower housing part at this location.

A holding contour 41 is provided approximately in the center of the interlocking plate 40, wherein the holding contour fixes the locking plate on the narrow sides 23 of the upper housing part, namely in a slot-shaped recess 24 provided for this purpose.

A holding and guiding device 45 is provided on the upper edge of the locking plate and bent at a right angle, wherein this holding and guiding device makes it possible to hold the unlatching ring 10 placed thereover in a stabilizing fashion.

In another variation shown in the figures (FIG. 2*c*), the interlocking plate is realized in the form of a so-called PE-spring contact 46.

FIGS. 2*a–c* also show different holding contours 41 for fixing the interlocking plate on the narrow sides of the upper housing part.

Figure 3:
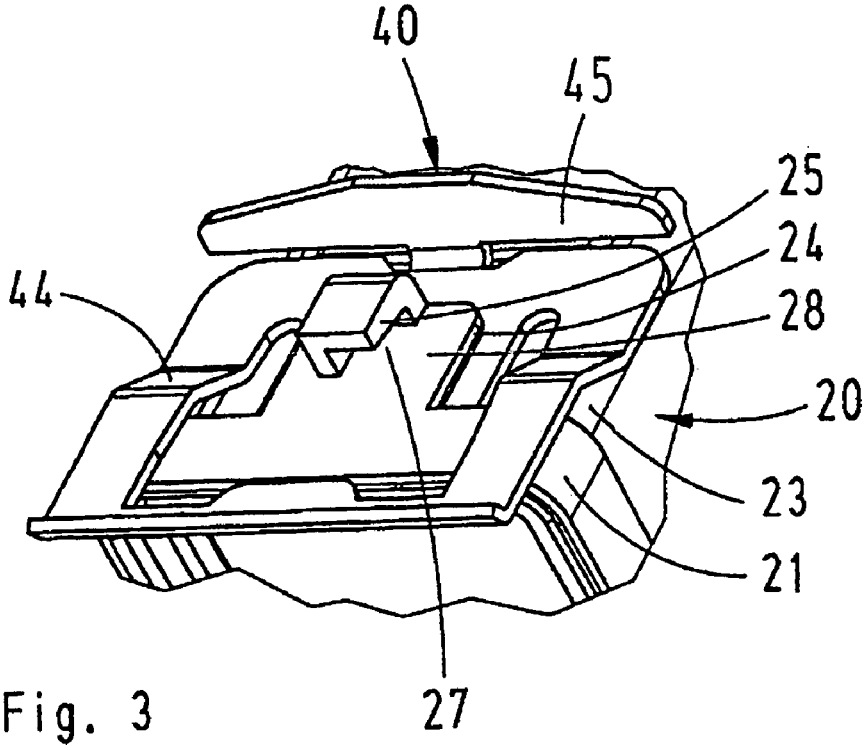
FIG. 3 is an installed sheet metal interlocking mechanism.

FIG. 3 shows a detail of the upper housing part 20 with its narrow side 23, on which the interlocking plate 40 is engaged.

This figure shows how the locking plate is fixed behind an upwardly protruding surface element 28 that is formed of the collar 21 and spaced apart from the narrow side 23, namely in the thusly formed slot 24. The locking pawl 25 is arranged on the surface element 28 and integrally formed over a corner of the surface element on two sides while the diagonally opposite corner is detached such that a pocket-like interlocking structure is formed.

During the unlatching process, a release pawl 15 engages into this pocket 27 as described further below.

Figure 4:
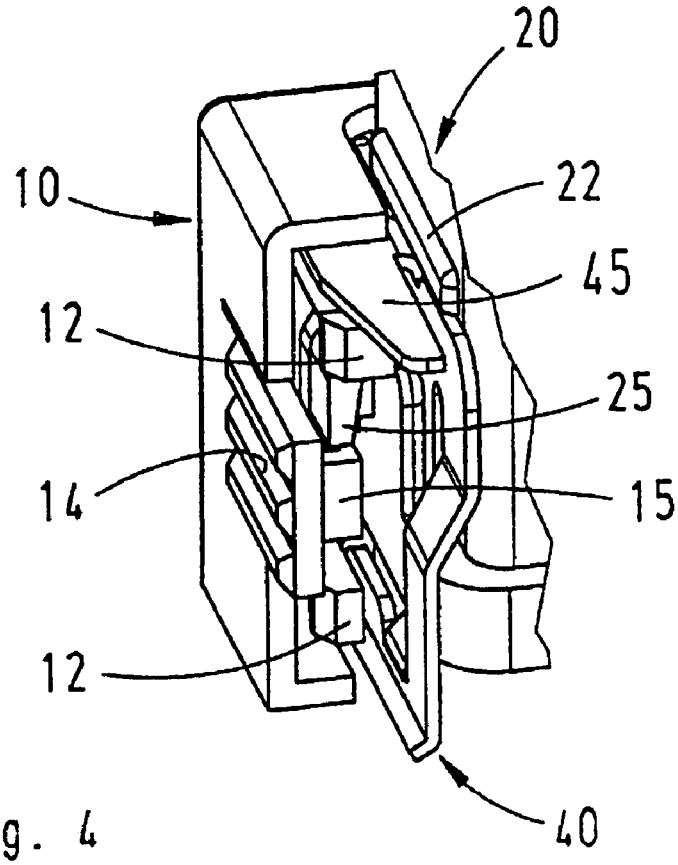
FIG. 4 is the latching mechanism in the unlatching ring.

FIG. 4 shows an enlarged detail of a perspective representation of the upper housing part 20, wherein a section of the unlatching ring 10 is omitted in order to show the other components required for realizing the latch.

The part of the unlatching ring 10 shown on the left side features a protruding actuating tab 14 that is detached on three sides and onto the inner side of which the release pawl 15 is integrally formed. The locking pawl 25 that protrudes from the narrow side of the upper housing part 20 is arranged above the release pawl 15.

This figure also shows two interlocking elements 12 that protrude from the unlatching ring and serve for respectively connecting or interlocking the second half of the not-shown unlocking ring section.

FIG. 5 shows a side view of the two interlocked housing parts 20, 30, the unlatching ring 10 and the arrangement of the interlocking plate 40 on the upper housing part 20.

This figure shows how the interlocking plate 40 is inserted into the slot 24 behind the surface element 28 and secured from sliding out by the strip 22.

In addition, this figure shows the engagement of the interlocking plate 40 on the snap-in tab 32 on the lower housing part 30, as well as the beveled element 18 that is positioned underneath the bevel 43 and integrally formed onto the unlatching ring 10.

In this respect, it should be noted that the beveled elements 18 are arranged in the corner regions of the unlatching ring and therefore situated outside the arrangement of the snap-in tabs 32 on the lower housing part.

FIGS. 6*a–d* show the function of the interlocking and latching mechanism in the form of a special section through the narrow sides 23, 33 of the two interconnected housing halves of 20, 30.

Figure 6A:
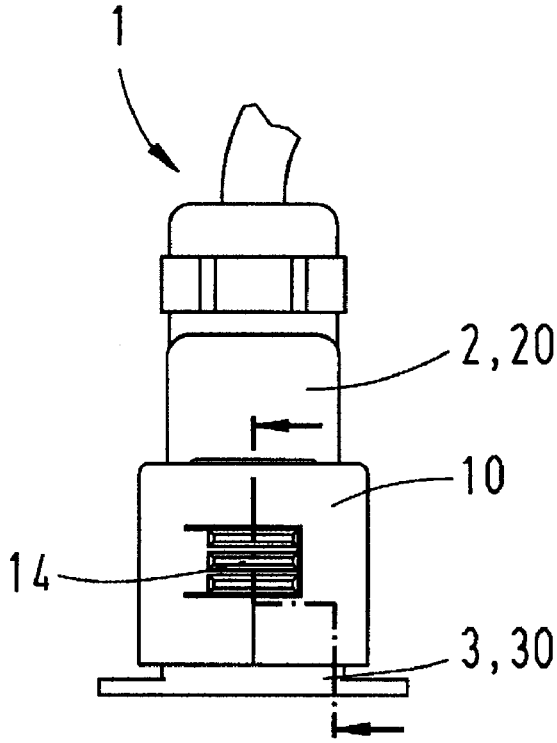
FIGS. 6*a*, 6*b*, 6*c* and 6*d* illustrate the function of the unlatching mechanism.
Figure 6B:
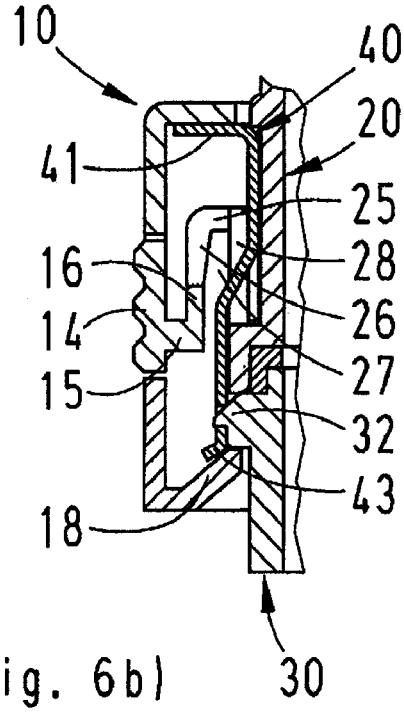

In the latched state, the two interlocking elements, the locking pawl 25 and the release pawl 15 are arranged directly on top of one another with their angled sections 16, 26 that lie perpendicularly opposite of another (FIG. 6*b*).

Figure 6C:
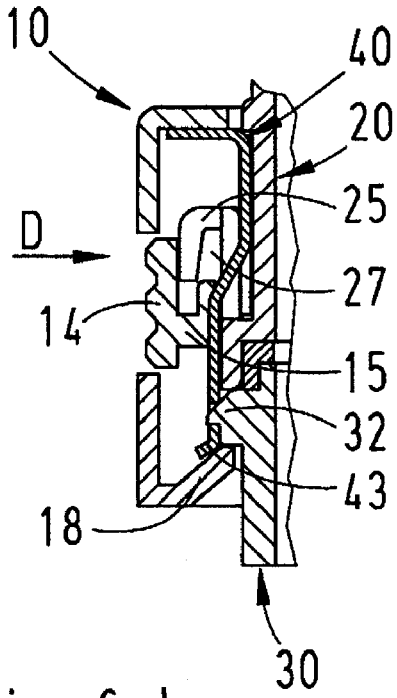
Figure 6D:
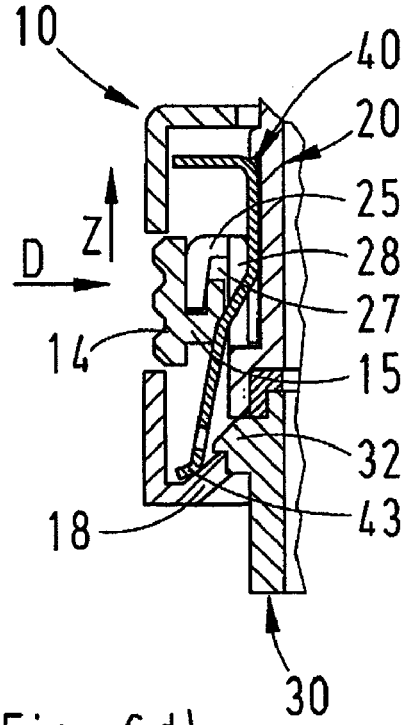

When pressure is exerted upon the actuating tab 14 on the unlatching ring 10 (in accordance with the arrow D), the lower release pawl 15 is pressed inward into the pocket 27 situated underneath the locking pawl 25 (FIG. 6*c*). This releases the interlocking mechanism and the unlatching ring 10 can be raised (in accordance with the arrow Z) (FIG. 6*d*).

The beveled elements 18 of the unlatching ring 10 that are arranged on the interlocking plate 40 underneath the bevel 43 simultaneously contact one another such that the lower section of the interlocking plate is pulled laterally outward and the interlock with the snap-in tabs 32 on the lower housing part 30 is disengaged, i.e., the upper housing part 20 or the connector 2 is completely separated from the lower housing part 30 or the mating connector 3, respectively.

What is claimed is:

1. A latching device for a connector formed of two connector housing halves comprising an upper housing part and a lower housing part with an axially displaceable unlatching ring that encompasses the upper housing part, wherein the unlatching ring has at least one user activated actuating tab that is detached on three sides and can be moved inward, and a release pawl with an inwardly directed angled section is integrally formed on said actuating tab, wherein a locking pawl with an outwardly directed angled section is integrally formed on the upper housing part, and wherein an inwardly directed angled section of the release pawl is arranged to contact, in the latched state of the connector, the outwardly directed angled section of the locking pawl that is formed on the upper housing part.

2. The latching device according to claim 1, wherein the unlatching ring is formed of two identical halves in the form of shells that are connected by snap-in elements.

3. The latching device according to claim 1, wherein the unlatching ring comprises a closed frame.

4. The latching device according to claim 1, having at least one interlocking plate arranged on the upper housing part.

5. The latching device according to claim 4, wherein the upper housing part is interlocked with snap-in tabs on the lower housing part by the interlocking plate.

6. The latching device according to claim 4, wherein the interlocking plate has a bevel that is acted upon by a bevel on the unlatching ring.

7. The latching device according to claim 4, wherein the unlatching ring comprises a closed frame.

8. The latching device according to claim 4, wherein the interlocking plate has at least one window-like cutout.

9. The latching device according to claim 4, wherein the upper housing part is interlocked with snap-in tabs on the lower housing part by the interlocking plate.

10. The latching device according to claim 9, wherein the interlocking plate has a bevel that is acted upon by a bevel on the unlatching ring.

11. The latching device according to claim 9, wherein the interlocking plate has at least one window-like cutout.

* * * * *